US008079418B2

(12) United States Patent
Brown et al.

(10) Patent No.: US 8,079,418 B2
(45) Date of Patent: Dec. 20, 2011

(54) PLUG IN PUMP FOR INVERTED SHROUD ASSEMBLY

(75) Inventors: Donn J. Brown, Broken Arrow, OK (US); Brown Lyle Wilson, Tulsa, OK (US); Steven K. Tetzlaff, Owasso, OK (US); John J. Mack, Catoosa, OK (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 12/476,831

(22) Filed: Jun. 2, 2009

(65) Prior Publication Data

US 2010/0300695 A1 Dec. 2, 2010

(51) Int. Cl.
*E21B 43/00* (2006.01)
*E21B 23/00* (2006.01)

(52) U.S. Cl. ..... 166/372; 166/382; 166/68; 166/105

(58) Field of Classification Search ..... 166/369, 166/372, 382, 68, 75.14, 75.13, 105
See application file for complete search history.

(56) References Cited

U.S. PATENT DOCUMENTS 6,260,627 B1 * 7/2001 Rivas ..... 166/369
6,412,563 B1 * 7/2002 St. Clair et al. ..... 166/372
6,964,299 B2 * 11/2005 Scarsdale ..... 166/105
7,367,410 B2 * 5/2008 Sangesland ..... 175/7
2007/0074872 A1 * 4/2007 Du et al. ..... 166/369
2008/0093085 A1 * 4/2008 Knight et al. ..... 166/369

OTHER PUBLICATIONS

John Mack and Pamela Hamblett; Increase Gas Production by Keeping ESPs Primed in High-Volume Gas Wells, pp. 38-41, based on the paper "Keeping ESPs Primed in High Volume Wells," presented at the 2004 SPE Gulf Coast ESP Pump Workshop held Apr. 28-30, 2004 in Houston, Texas.

* cited by examiner

*Primary Examiner* — Jennifer H Gay
*Assistant Examiner* — Catherine Loikith
(74) *Attorney, Agent, or Firm* — Bracewell & Giuliani LLP

(57) ABSTRACT

The pump can be utilized in gassy oil wells to prevent gas slugs from locking the electrical submersible pump. A shroud assembly is provided with a bottom that can be fixed to the top of a seal section connected to the top of a motor. Additional lengths of shroud can be added as the shroud assembly is lowered into the well. The electrical submersible pump can then lowered into the shroud and supported from a production tubing string. A hanger can then be attached to the production tubing string to carry the weight of the shroud assembly, motor, and seal section.

17 Claims, 3 Drawing Sheets

PLUG IN PUMP FOR INVERTED SHROUD ASSEMBLY

FIELD OF THE INVENTION

This invention relates in general to installation of electrical submersible pumps (ESPs), and in particular the installation of ESP equipment inside an inverted shroud.

BACKGROUND OF THE INVENTION

A typical subsea installation can use an Electric Submersible Pump (ESP) within an inverted shroud. An ESP unit consists of a motor section, a seal section, and a pump section having an inlet and a discharge connected to production tubing and is used to provide artificial lift to liquid from a formation.

An inverted shroud can be used in combination with an ESP for use in gassy wells to divert the gas past the entrance of the ESP to reduce the possibility of gas locking. The shroud is a cylindrical steel tube that encompasses the ESP and is sized to allow clearance for fluid to pass both inside past the ESP and outside between the well casing and the shroud.

In gassy oil wells, gas and liquid enter the casing from the formation then both travel up the casing past the ESP unit to the top of the shroud. Due to gravity, the liquid can fall back down inside the shroud, which has an open top, and into the entrance of the pump. Gas slugs, however, effectively continue moving past the ESP. This reduces the chances for the ESP to experience gas locking due to gas slugs.

The assembly and installation of an inverted shroud with an ESP is very time consuming and difficult because the shroud, the pump, and lengths of production tubing must be assembled in unison as it is lowered into the hole. Parts for the assembly must be manufactured to strict tolerances in order to allow for proper assembly. Further, the diameter of the shroud limits the size of the motor that can be used for the ESP, which in turn affects the capability of the ESP to produce artificial lift.

A need exists for a technique that addresses the limitations and shortcomings described above. In particular a need exists for a technique to allow for an inverted shroud to be installed with an ESP in a timely manner and in a manner that does not limit the size of the motor that can be used. The following technique may solve these problems.

SUMMARY OF THE INVENTION

In an embodiment of the present technique, a shroud assembly is provided with a bottom that can be fixed to the top of a seal section connected to the top of a motor. Additional lengths of shroud can be added as the shroud assembly is lowered into the well. This allows for a relatively less time consuming and less difficult assembly process as the shroud can be assembled independently from the electrical submersible pump (ESP) and the production tubing, which in the past have been assembled in unison with the shroud. Further, assembly of the shroud in this manner makes the motor size independent from the inner diameter of the shroud because the motor is not located within the shroud.

In the illustrated embodiment, a motor is located at the base of an assembly with a seal section through which the motor shaft passes. A power cable descends from the surface and runs along between the casing and the shroud to serve the motor. The shaft protrudes into a special section of shroud about a foot in length that is bolted onto the seal section. The pump is connected to the protruding shaft and can have multiple stages. The pump can also have a pump positioner or guide at the base to aid in positioning the pump. Additional sections of shroud extend upwards from the special section of shroud and house the ESP within. The shroud sections can be sections of pipe connected end to end and can extend up to 300 feet or more above the ESP. Inlet holes are located approximately at the top end of the shroud to allow formation liquid to enter the shroud and fall down to the entrance of the ESP.

The discharge of the ESP located inside the shroud connects to production tubing that extends past the top of the shroud and to the surface. A shroud hanger located at the top of the shroud supports the weight of shroud assembly comprising the shroud, motor, and seal section, and transfers the weight to the production tubing via the hanger.

During installation of the shroud assembly and ESP, a clamp at the wellhead holds the assembled components, and a lifting clamp lifts the next component over the wellhead to be assembled. For example, the clamp at the wellhead initially holds the assembled seal section to support the seal section and the motor connected below. The special shroud section, about a foot in length and housing a protruding shaft spline from the motor, is lifted with a second clamp and placed over the seal section located at the wellhead. The special shroud section can then be bolted onto the seal section. Once the special section of the shroud is bolted onto the seal section, the clamp holding the seal section can be released and then replaced by the clamp used to lift and hold the special shroud section so that it sits on the wellhead. This alternating use of the lifting clamp and the clamp at the wellhead is used to add additional sections of shroud.

Once the shroud sections are assembled, the ESP can be lifted and lowered down inside the shroud until it engages the shaft spline of the motor protruding into the special shroud section. At this point the top of the shroud is still supported by a clamp at the wellhead. Once the ESP is positioned within the shroud, a section of production tubing is lifted with a clamp and lowered down inside the shroud to connect with the discharge end of the ESP. As with the shroud sections, additional production tubing sections are lifted and connected end to end by releasing the clamp holding the assembled production tubing at the wellhead and replacing it with the clamp holding the last added section of production tubing. A hanger is then installed at the top of the shroud at the point where the length of production tubing is sufficient to extend to or above the top of the shroud. The hanger engages the production tubing to thereby transfer the weight of the shroud assembly to the production tubing, allowing the clamp holding the shroud assembly to be released. The production tubing along with the shroud assembly and the ESP within are then lowered to the desired depth in the well for operation, with additional sections of production tubing added to extend the production tubing up to the wellhead.

DETAILED DESCRIPTION OF THE INVENTION

Figure 1:
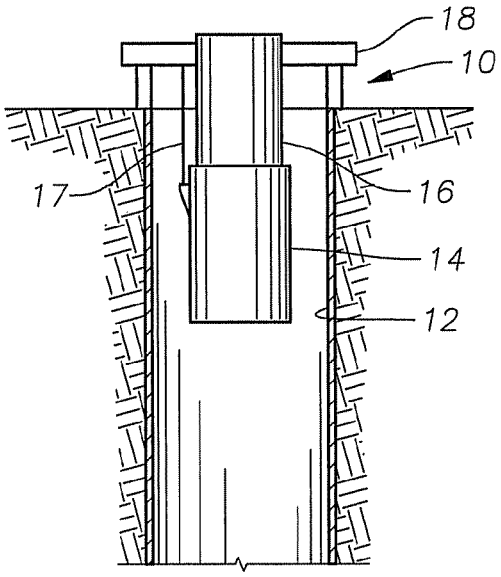
FIG. 1 shows a seal section and a motor section clamped to the wellhead, in accordance with the invention.

Referring to FIGS. 1 through 5, an embodiment of the installation of a shroud 24 with a pump 26 is illustrated. Pump 26 is a rotary pump such as a centrifugal pump or progressing cavity pump. Referring initially to FIG. 1, a motor 14 connected to the lower end of a seal section 16 is shown suspended inside a well casing 12. A power cable 17 is connected to the motor 14 and runs up to the surface of the well. A clamp 18 supports the assembled motor 14 and seal section at the wellhead 10 by holding the seal section 16. Clamp 18 can be slips or a spider type of supporting system. Clamp 18 may be located on a rig floor of a workover rig.

Figure 2:
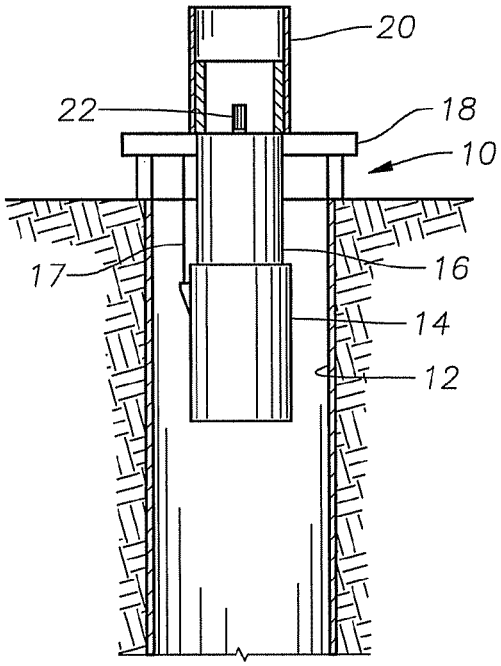
FIG. 2 shows a shroud section with a pump positioner attached to the seal section, in accordance with the invention.
Figure 4:
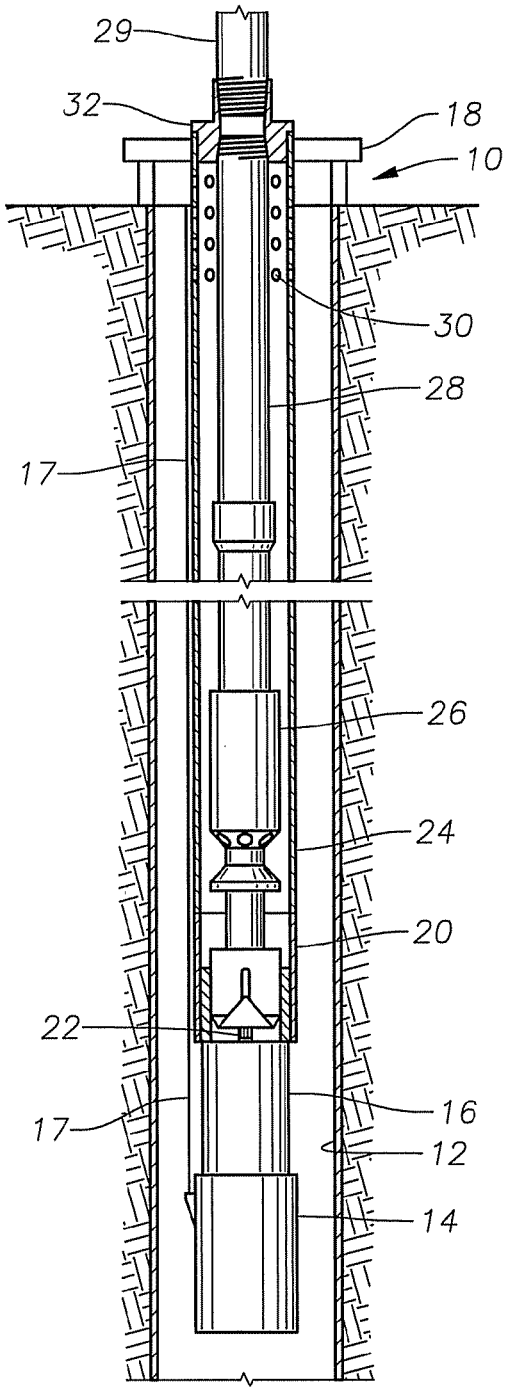
FIG. 4 shows the pump lowered by production tubing into the shroud and mated with the pump positioner, the shroud being hung off the production tubing in accordance with the invention.

A second clamp (not shown), of the workover rig, typically a pipe elevator, can then lift the next component to be assembled as shown in FIG. 2. For example, in this embodiment a special shroud section 20 is lifted with the second clamp (not shown) and can be bolted to the top of the seal section 16 held by the clamp 18 at the wellhead 10. The clamp 18 at the wellhead 10 is released and replaced by the lifting clamp, thereby moving the assembled components downward into the well. The special shroud section 20 can be approximately a foot in length and houses a spline shaft 22 to mate with and align the pump 26 (FIG. 4). The special shroud section also has an anti-rotational slot or key (not shown) to prevent the pump 26 from rotating.

Figure 3:
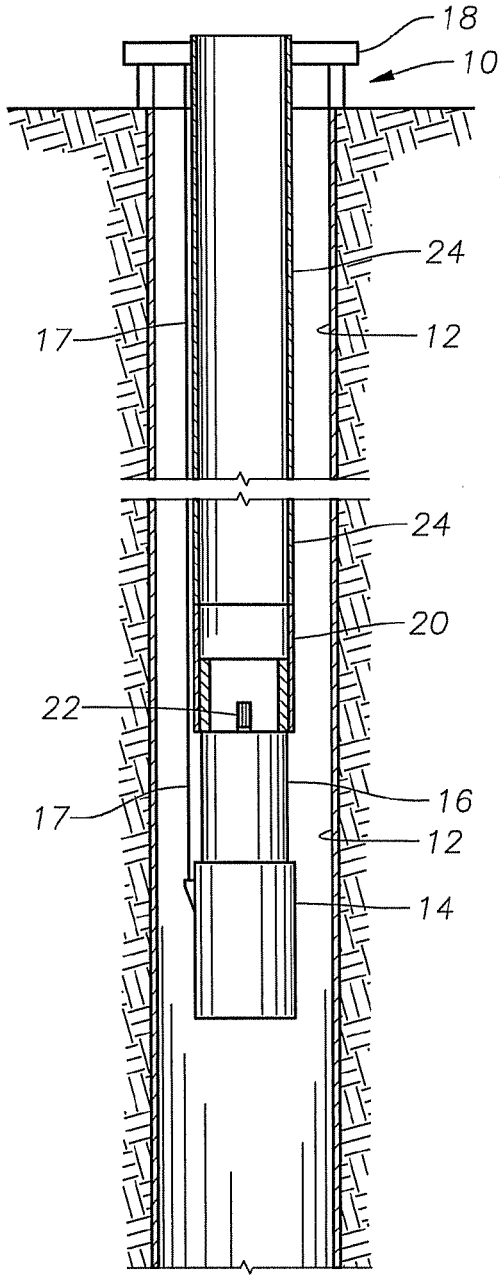
FIG. 3 shows the top of the completed shroud clamped at the wellhead and the motor and seal attached to the bottom, in preparation to receive a pump, in accordance with the invention.

As shown in FIG. 3, the shroud 24 can be comprised of sections of pipe, such as casing, connected end to end. The sections of shroud 24 can be lifted by the lifting clamp (not shown) and connected to the previous section of shroud 24 supported at the wellhead 10 by the clamp 18. The clamp 18 at the wellhead can then be released and replaced by the lifting clamp in the same manner described for the special shroud section 20 above. This procedure of replacing the clamp 18 at the wellhead 10 with the lifting clamp is repeated until the desired shroud length is reached. The uppermost section of shroud 24 has an intake, such as inlet holes 30 in the side wall near the top. The lower end of shroud 24 is closed.

Referring to FIG. 4, once the shroud 24 sections are assembled, the pump 26 can be lifted and lowered down inside the shroud until it engages a spline shaft 22 and also engages the anti-rotation slot or key (not shown). At this point the top of the shroud 24 is still supported by clamp 18 at the wellhead 10. Once the pump 26 is positioned within the shroud, a section of production tubing 28 is lifted with a clamp (not shown) and lowered down inside the shroud 24 to connect with the discharge end of the pump 26. As with the shroud 24 sections, additional production tubing 28 sections are lifted and connected end to end by releasing the clamp 18 holding the assembled production tubing 28 at the wellhead 10 and replacing it with the clamp holding the last added section of production tubing 28. The tubing inside shroud 24 may be considered to be a lower production tubing string 28. Shroud 24 remains suspended at wellhead 10 during this process.

Figure 5:
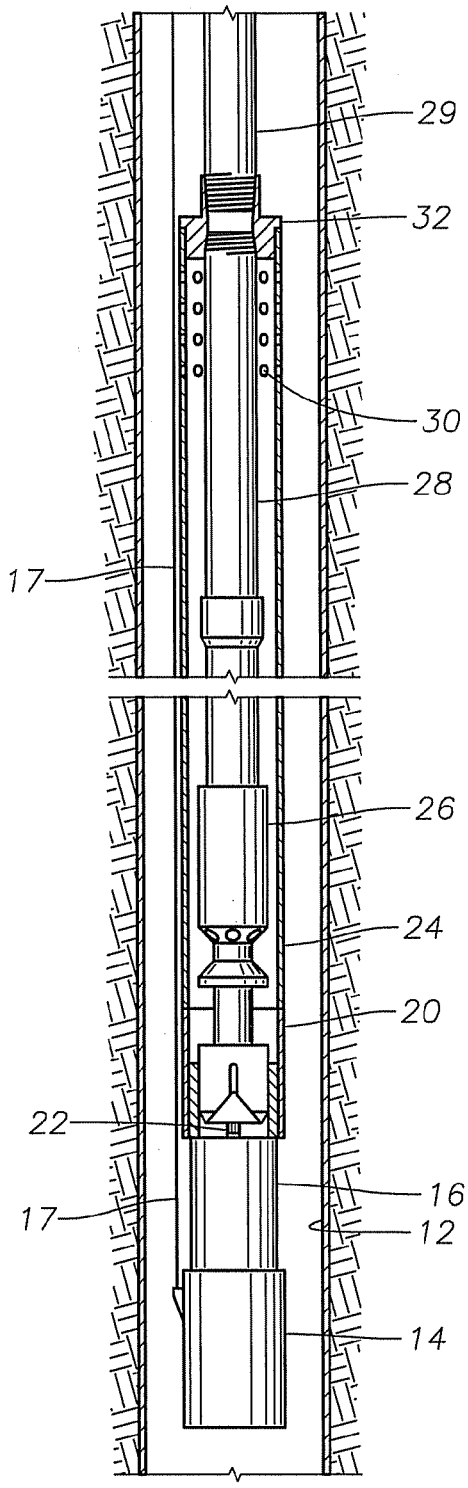
FIG. 5 shows the pump, seal section, motor, and shroud assembly lowered by production tubing to the desired location in the well, in accordance with the invention.

A hanger 32 is then installed at the top of the shroud 24 at the point where the length of lower production tubing 28 is sufficient to extend to or above the section of shroud 24 having inlet holes 30. The inlet holes 30 allow formation liquid to enter the shroud 24 and flow down to the entrance of the pump 26 during operation. The hanger 32 engages the upper production tubing 29 to thereby transfer the weight of the shroud 24, motor 14, and seal section 16, to the upper production tubing 29 via the hanger 32. Once the hanger 32 is installed, the clamp 18 holding the shroud 24 can be released. The lower production tubing 28, pump 26, along with the shroud assembly comprising the shroud 24, motor 14, and seal section 16, are then lowered to the desired depth in the well for operation, as shown in FIG. 5, with additional sections of upper production tubing 29 added to extend the production tubing up to the wellhead.

Hanger 32 has external threads that engage internal threads formed in the upper section of shroud 24. Hanger 32 has internal upper and lower threads for securing upper tubing string 29 and lower tubing string 28.

Figure 6:
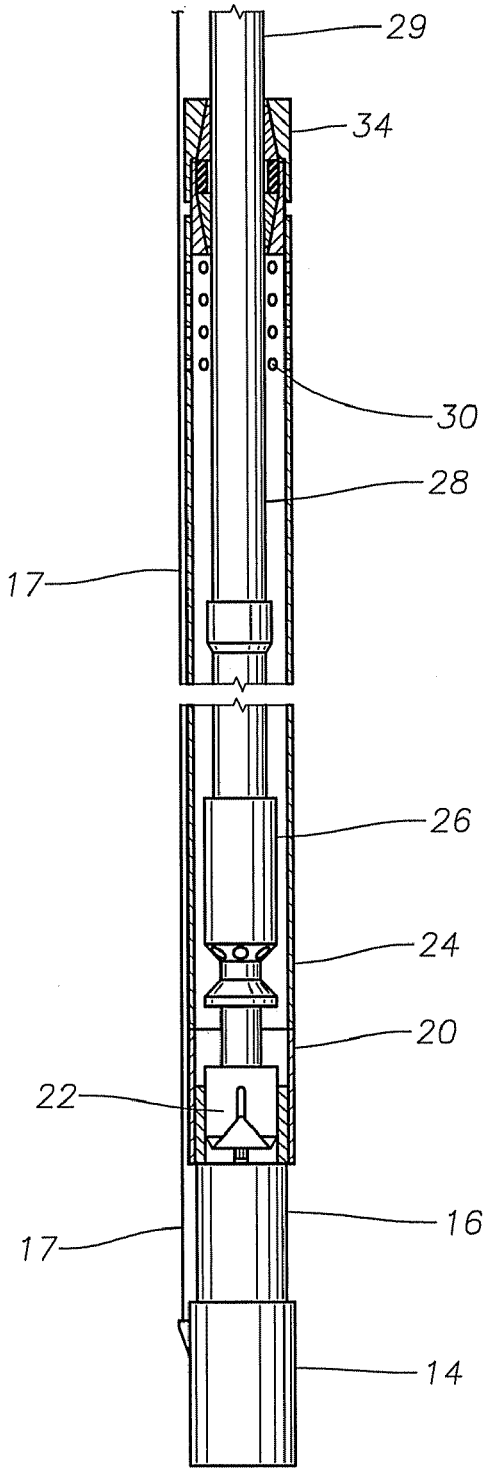
FIG. 6 shows an additional embodiment of the assembly varying in the type of hanger used to support the shroud off of the production tubing in accordance with the invention.
Figure 7:
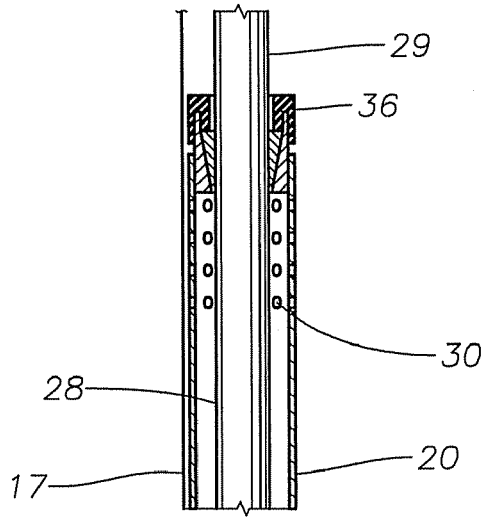
FIG. 7 shows another additional embodiment of the assembly varying in the type of hanger used to support the shroud off of the production tubing in accordance with the invention.

In other embodiments illustrated in FIGS. 6 and 7, different types of hangers can be utilized. The hangers 34, 36 shown are also used to hang the shroud assembly from the production tubing 28. FIG. 6 shows a hanger 34 having a lower slip with a lower tapered bowl. The lower tapered bowl has external threads that engage internal threads formed in the upper section of shroud 24. To prevent upward movement of the production tubing due to thermal growth, the hanger 34 additionally comprises an upper slip with an upper tapered bowl. A set of internal threads on the upper tapered bowl engages external threads on the lower tapered bowl.

FIG. 7 shows a hanger 36 having a lower slip with a lower tapered bowl. The lower tapered bowl has external threads that engage internal threads formed in the upper section of shroud 24. A retainer secures the slip to prevent upward movement of the slip.

Figure 8:
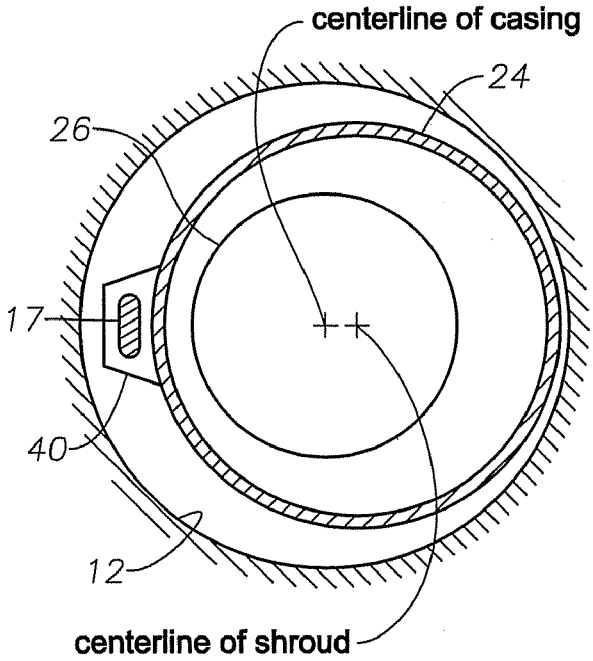
FIG. 8 shows a sectional top view of the shroud offset from the center of the well to provide clearance for a power cable guard, in accordance with the invention.

FIG. 8 shows a sectional top view of the shroud 24 offset from the center of the well to provide clearance for a power cable guard 40 attached to the exterior of the shroud 24. The electrical power cable 17 is routed inside the guard 40 to protect it from damage. The guard 40 can comprise a continuous channel or can be comprised of a plurality of spaced apart channels.

In an additional embodiment (not shown), the power cable 17 can run inside the shroud 24. The power cable 17 could stab into an electrical connector assembled as part of the special shroud section 20 at the base of the pump 26.

Assembling the shroud assembly comprising the shroud 24, motor 14, and seal section 16 prior to the installation of the pump 26 and production tubing 28 can reduce installation time and difficulty by eliminating the need for strict tolerances required when the shroud assembly, ESP, and production tubing are assembled in unison. Further, the size of the motor is not limited by the shroud diameter because the motor is installed prior to and outside the shroud, allowing for a larger motor size. In the example shown in the figures, the outer diameter of motor 14 is greater than the inner diameter of shroud 24.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. For example, a rotary gas separator could be located in shroud below pump as part of the pump assembly. If so, however, a gas outlet diverter would be connected between a exterior port of the shroud and the cross over of the gas separator.

What is claimed is:

1. A well fluid production assembly comprising:

an upper production tubing string suspended in a cased well;

a shroud connected to a lower end of the upper production tubing string;

a motor assembly having an upper end secured directly to a lower end of the shroud and extending below the shroud and having a shaft end protruding into the shroud;

a pump assembly lowered into the shroud and stabbed into engagement with the shaft end of the motor assembly, the pump assembly having an intake within the shroud;

a lower production tubing string within the shroud and connected between the pump assembly and the upper production tubing sting; and an inlet in an upper portion of the shroud above the intake of the pump assembly for admitting well fluid surrounding the shroud to the intake of the pump assembly.

2. The production assembly of claim 1, wherein the inlet in the shroud is located in a sidewall of the shroud.

3. The production assembly of claim 1, further comprising an electrical power cable for providing electrical power to the motor, the electrical power cable being fastened to the outside of the shroud.

4. The production assembly of claim 1, further comprising a hanger secured to an upper end of the shroud, the hanger comprising slips for gripping the lower production tubing string.

5. The production assembly of claim 1, further comprising a hanger secured to an upper end of the shroud, the hanger comprising lower slips and upper slips for gripping the lower production tubing string, the lower slips and upper slips acting in opposite directions.

6. The production assembly of claim 1, further comprising an anti-rotation member in the shroud that is engaged by the pump assembly as the pump assembly stabs into the shaft end of the motor assembly, the anti-rotation member preventing rotation of a housing of the pump assembly.

7. The production assembly of claim 1, further comprising a hanger securing to the shroud, the hanger having an upper end connected to the upper production tubing string and a lower end connected to the lower production tubing string, the hanger having a seal to seal an upper end of the shroud to the lower production tubing string.

8. The production assembly of claim 1, wherein the upper end of the motor assembly is bolted to the lower end of the shroud.

9. A well fluid production assembly comprising:

a shroud adapted to be suspended on a production tubing string;

a motor assembly having an upper end secured to a lower end of the shroud, the motor assembly extending below the shroud and having a shaft end protruding into the shroud, the motor assembly having a larger diameter than an inner diameter of the shroud so as to be unable to be positioned in the shroud;

a pump assembly being lowered into and positioned within the shroud, the pump assembly being stabbed into engagement with the shaft end of the motor assembly;

an anti-rotation member in the shroud that is engaged by the pump assembly to prevent rotation of a housing of the pump assembly, the pump assembly having an intake in the shroud and a discharge on upper end;

wherein the discharge is adapted to be connected within the shroud to a lower portion of the production tubing string;

a hanger secured to an upper end of the shroud for connecting the shroud to the production tubing string; and an inlet in an upper portion of the shroud for admission of well fluid surrounding the shroud to the intake of the pump assembly.

10. The production assembly of claim 9, further comprising an electrical power cable for providing electrical power to the motor assembly, the electrical power cable fastened to the outside of the shroud, a centerline of the pump being offset from a centerline of shroud.

11. The production assembly of claim 9, wherein the hanger has slips for gripping the production tubing string.

12. The production assembly of claim 9, wherein the hanger has lower slips and upper slips for gripping the production tubing string.

13. The production assembly of claim 9, wherein the hanger has lower slips and upper slips for gripping the production tubing string, the hanger having a seal located between the lower and upper slips for sealing to the production tubing string.

14. A method for producing well fluid from a well, comprising:

a) securing an upper end of a motor assembly to and below a lower end of a shroud such that a power shaft end protrudes into the shroud and a remaining portion of the motor assembly is suspended below the shroud;

b) making up a full length of the shroud and suspending in a cased well the shroud with the motor assembly attached thereto;

c) securing a pump assembly to a lower end of a lower production tubing string and lowering the pump assembly on the lower production tubing string into the suspended shroud, which has the motor assembly attached thereto;

d) stabbing a lower end of the pump assembly into the shaft end of the motor assembly, and positioning an intake of the pump assembly within the shroud;

e) attaching an upper end of the lower production tubing string to an upper end of the shroud and to an upper production tubing string;

f) lowering the shroud, the pump assembly and the motor assembly on the upper production tubing string to a desired depth in the well;

g) operating the motor assembly to rotate the pump assembly, flowing well fluid through an inlet in an upper portion of the shroud to the intake of the pump assembly, and pumping well fluid through the lower and upper production tubing strings.

15. The method of claim 14, further comprising the step of connecting an electrical power cable to the motor assembly and fastening the power cable to the outside of the shroud.

16. The method of claim 14, wherein step (a) comprises bolting an upper end of the motor assembly to the lower end of the shroud.

17. The method of claim 14, wherein step (e) comprises mounting a set of slips between the upper end of the shroud and the lower production tubing string.

* * * * *